United States Patent [19]

Godard et al.

[11] 4,033,577

[45] July 5, 1977

[54] SHEET FEEDING DEVICES

[75] Inventors: Bernard Godard, Nueville les Dieppe; Roger Gomitoli, Arques la Bataille, both of France

[73] Assignee: La Cellophane, Paris, France

[22] Filed: Sept. 12, 1975

[21] Appl. No.: 612,758

[30] Foreign Application Priority Data

Sept. 18, 1974 France ..... 74.31466

[52] U.S. Cl. ..... 271/128; 271/160; 271/170

[51] Int. Cl.[2] ..... B65H 1/08; B65H 3/02

[58] Field of Search ..... 271/19, 24, 42, 127, 271/128, 160, 170, 118

[56] References Cited

UNITED STATES PATENTS

| | | | |
|---|---|---|---|
| 1,951,067 | 3/1934 | Shepherd | 271/24 |
| 2,827,288 | 3/1958 | Geisler | 271/42 |
| 3,379,433 | 4/1968 | Gates | 271/42 |
| 3,520,533 | 7/1970 | Phelps et al. | 271/127 |
| 3,533,617 | 10/1970 | Collins | 271/127 |
| 3,758,105 | 9/1973 | Okamoto | 271/127 |
| 3,806,112 | 4/1974 | Melby et al. | 271/127 |

OTHER PUBLICATIONS

Graf, Rudolf F., *Modern Dictionary of Electronics;* Howard W. Sams & Co., Inc., Third Ed., 1970, p. 467.

Rogers, "Cut Sheet Feed Device," IBM Technical Disclosure Bulletin, vol. 14, No. 5, Oct. 1971.

*Primary Examiner*—Robert W. Saifer

[57] ABSTRACT

Feed mechanism for delivering copy sheets in photocopy machines which comprises a frame, a hopper mounted on said frame and provided on its front edge portion with pin means against which is applied the pile of sheets being fed, mobile plate means for holding said sheets, said mobile means being articulated around a crosswise axis placed plumb to its center of gravity, a counterweight means on said mobile plate means located on the side opposite said pin means, and drive means for disengaging the sheets of paper one by one.

4 Claims, 1 Drawing Figure

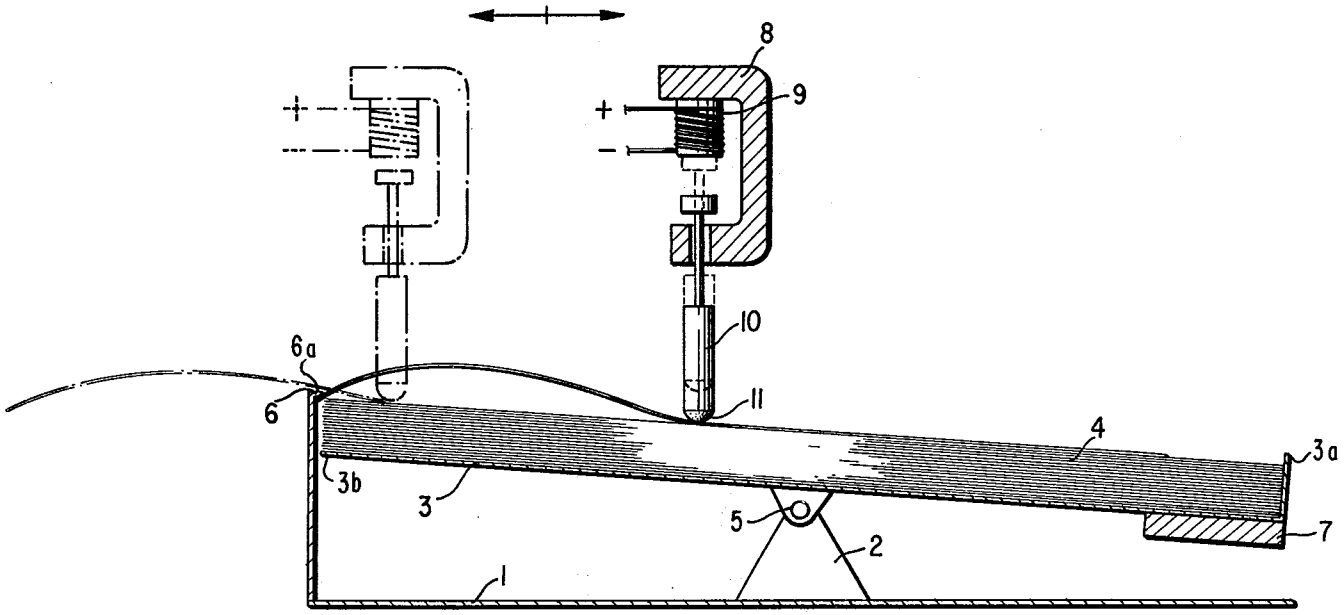
3a
7
4
2
5
8
9
10
11
+
−
1
3
3b
6a
6

SHEET FEEDING DEVICES

The present invention relates to a sheet feeding device for machines such as document reproduction machines.

Photocopy machines have been provided in the prior art whereby an original sheet inserted into the machine is transported to an exposure device, along with a copy sheet which is fed from a stack of such sheets within the machine. The exposure device produces an image of the original sheet on the copy paper. Provision is made for developing and fixing the image on the copy sheet so as to produce a finished photocopy.

The general objective of the present invention is to provide an improvement in a feed mechanism which functions automatically and at high speeds in response to the insertion of the original sheet.

It is essential, especially when they work at high speed, that these machines deliver one and only one sheet at a time. Actually, troublesome operating problems occur when by accident the copy sheet is not delivered at the right moment or if several are delivered at the same time.

The objectives of the present invention are achieved by placing the sheets in a hopper whose front edge is provided with pull-off or delivery pins, i.e., pins projecting a few millimeters inside the hopper, covering over the short distance the edge of the pile of sheets contained therein. Generally, a system is provided with a slight spring means which rests against the pull-off or delivery pins for the ream of sheets to be used. To disengage a sheet and only one sheet, according to this process, there is brought in contact with the sheet placed on top of the ream, a turning roller covered with a substance of only slight hardness, such as rubber. The rotation of the cylinder makes this top sheet curve against the pull-off or delivery pins, and makes only this sheet curve until the curve becomes more pronounced so that the front edge of the sheet on top escapes the pull-off or delivery pins. The sheet is then carried into the machine, for example, between two rollers turning tangentially at the desired speed.

Prior art systems require a mechanic driving the machine to make the roller turn and a rotation control of the latter at a determined moment for stopping when the copy sheet is in place. Such a system has not been proven sufficiently reliable, the pressure exerted by the drive roller being, in particular, delicate to adjust and maintain as the number of sheets contained in the hopper decreases.

The present invention has for its object a pull-off or delivery device which does not resort to a pressure by a spring means and thereby is much more reliable.

The device of the present invention is made up of a mobile plate placed in a hopper provided with pull-off or delivery pins and on which rests a package of sheets, the plate being articulated around an axis located vertical to the center of gravity of the mobile unit and being provided with a counterweight so that the front edge of the pile of sheets which rests on the plate is constantly applied against the pull-off or delivery pins.

According to the present invention, there is provided a drive means of one or more vertical delivery pins, whose ends are provided with rubber shoes and whose weight is on the whole slightly less than that of the counterweight. The drive means is applied on the upper sheet and by a back-and-forth movement disengages it.

The weight of the counterweight is of the same order as that of the drive means, and as the latter approaches the end of the sheet, the pressure that it exerts on the sheet increases so as to facilitate disengagement without running the risk of causing the support plate to swing. It can be seen that this device, independent of any pressure adjustment and amount of sheets that the hopper contains, is particularly reliable.

Once the delivery pins have reached the end of their travel and once the upper sheet has been disengaged, the pins in question are lifted upward and brought back to their starting position.

The combined reciprocal movement and lifting of the delivery pins can be produced by any known means, such as electromagnetically. A support in which the pins slide vertically can be given a reciprocal movement. The electromagnets, solid with the support holding the pins in lifted position at the time of its backward movement and ceasing to exert any magnetic pull at the time of its forward movement which constitutes the drive phase, may be used.

Since the drop of the pins occurs in the vicinity of the center of gravity of the mobile system, its impact is insufficient to counterbalance the action of a counterweight and ceases applying the front edge of the pile of sheets against the pull-off or delivery pins.

BRIEF DESCRIPTION OF THE DRAWING

The invention will be better understood with the aid of the accompanying drawing wherein:

FIG. 1 schematically represents a device according to the invention.

DESCRIPTION OF THE PREFERRED EMBODIMENT

As seen in the drawing, a hopper for sheet material is provided a frame 1 comprising a base 2 on which is pivoted a plate 3 on which rests a stack 4 of copy sheets that are ready for use. A point of articulation 5 is placed plumb with the center of gravity of the mobile system which comprises a plate 3 and the stack of sheets 4 which it supports.

Frame 1 is provided in its front path with pull-off or delivery pins 6 which serve as stops fastened at the end opposite that of the pull-off or delivery pins is a counterweight 7. The pins 6 have lips **6*a*, which overlie the front edge of the stack of sheets 4, and the counterweight 7 urges the hopper to rotate, so that the top sheet is urged against the lips 6*a***.

A sheet drive system is made up, according to the present embodiment, of a horizontally mobile carriage 8 which comprises one or more electromagnets 9 that are able to attract upward one or more pins 10 which slide freely in carriage 8. The pins are provided on their lower part with rubber ends or shoes 11 for frictionally engaging the top sheet of paper.

The weight of counterweight 7 is calculated so as to balance the total weight of sliding pins 10 when they rest on the stack of sheets 4 in the vicinity of the pull-off or delivery pins 6 which serve as stops. Preferably, the counterweight is of a value of slightly greater weight than the sliding pins.

OPERATION

The operation of the system is as follows:

The mobile carriage 8, which moves horizontally under the influence of any known means, comes to the end of its travel not far from base 2, approximately in the position where it is represented by solid lines in the accompanying drawing. The current which energizes the electromagnet and applies against it the upper end of sliding pins 10 is cut off by any known means.

The sliding pins 10 by falling, come in contact by means of rubber shoes 11 with the top sheet of the stack whose end under the influence of counterweight or load 7 is applied against the lips 6*a* of the pull-off or delivery pins 6 which serve as stops.

Mobile carriage 8 then advances in the direction of the pull-off or delivery pins 6, carrying the sliding pins 10 which under the influence of their weight alone advances the top sheet of the stack. This top sheet curves because its end is held by the lip 6*a* pull-off or delivery pins 6. In other words, the top sheet buckles. This is because a first end of the top sheet is urged against the delivery pins 6, while being held down by the overlying lips 6*a*. Meanwhile, the advancing sliding pin 10 drags the opposite or second end of the top sheet toward the pin 6.

As the shoes of the sliding pins approach the pull-off or delivery pins 6, the curving or buckling is accentuated until the stiffness of the sheet causes its end to escape from or snap over the pull-off or delivery pins and be grabbed by a carrying system (not shown).

In the position shown by dotted lines on the accompanying drawing, the sliding pins exert an increased pressure on the mobile system which is articulated or pivoted around point 5 but never exceeds the opposite action of a counterweight. In this position, the system is closed to its equilibrium which facilitates the disengagement of the sheet but is without the mobile system which runs the risk of swinging.

When the mobile carriage has reached the position at the end of its travel, the electromagnet 9 is energized by any known means, not shown, and retracts the sliding pins 10 upward. The carriage 8 then comes back to its starting position and the cycle recommences.

It can be seen that this system which does not have any spring means whose tension can become unadjusted is particularly reliable.

Of course, the drive system and the system for lifting the sliding pins is assured, according to this embodiment, by the electromagnetic means described above, but can be replaced by any other known systems, mechanical, electrical, pneumatic, or other, without thereby going outside the scope of the invention.

Although the present invention has been described with reference to a single embodiment thereof, it should be understood that numerous other modifications and embodiments can be devised by those in the art that will fall within the spirit and scope of the principles of this invention.

What is claimed is:

1. A mechanism for feeding sheets of paper by advancing a top sheet from a stack of sheets, said mechanism comprising:

hopper means for carrying said paper, said hopper means having a closed end and an open end;

pivot means for supporting said hopper means to pivot about an axis aligned with the center of gravity of the hopper;

a load secured to the hopper on the same side of the axis as the closed end, said load creating a moment for urging said hopper to pivot in one direction about said axis;

stop means positioned adjacent the open end of said hopper means, wherein said hopper means moves relative to said stop means upon pivoting about said pivot, and wherein said stop means abuts the top sheet of paper to limit rotation of said hopper about said pivot in said one direction;

paper engaging means positioned above said hopper for engaging the top sheet of paper intermediate the ends thereof, wherein said paper engaging means is freely supported to rest on said top sheet and has a weight sufficient to effect frictional coupling between said top sheet and said paper engaging means, so that when said paper engaging means is advanced, said top sheet moves relative to the sheet upon which the top sheet rests, and wherein, the weight of the paper engaging means exerts a moment on said hopper which is opposite to, but less than, the moment created by said means for operating said paper engaging means to cause the paper engaging means to push the top sheet of paper against said stop so as to buckle said sheet between the stop and paper engaging means to separate said top sheet from said stack and, upon further advancement, to feed said top sheet over said stop means, and means for retracting the paper engaging means from the stack of paper, after the top sheet has been fed and for releasing the paper engaging means upon returning the paper engaging means to the starting point.

2. The mechanism of claim 1, wherein said means for operating said paper engaging means includes means for moving said paper engaging means toward the open end of said hopper from a starting point between said pivot and said open end when feeding said top sheet.

3. The mechanism of claim 2, wherein the retracting means is an electromagnet.

4. The mechanism of claim 1, wherein the retracting means is an electromagnet.

* * * * *

UNITED STATES PATENT OFFICE

CERTIFICATE OF CORRECTION

Patent No. 4,033,577 Dated July 5, 1977

Inventor(s) GODARD, ET AL.

It is certified that error appears in the above-identified patent and that said Letters Patent are hereby corrected as shown below:

Claim 1, column 4, line 31, after "said", insert -- load; --.

Signed and Sealed this

*Fourth* Day of *October 1977*

[SEAL]

*Attest:*

RUTH C. MASON
*Attesting Officer*

LUTRELLE F. PARKER
*Acting Commissioner of Patents and Trademarks*